US010579010B2

(12) United States Patent
Ogawa et al.

(10) Patent No.: US 10,579,010 B2
(45) Date of Patent: Mar. 3, 2020

(54) TONER CASE, IMAGE FORMING APPARATUS AND TONER KIT

(71) Applicant: KYOCERA Document Solutions Inc., Osaka (JP)

(72) Inventors: Naozumi Ogawa, Osaka (JP); Hiroshi Wada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/384,642

(22) Filed: Apr. 15, 2019

(65) Prior Publication Data

US 2019/0317447 A1 Oct. 17, 2019

(30) Foreign Application Priority Data

Apr. 16, 2018 (JP) ..... 2018-078510

(51) Int. Cl.
*G03G 21/16* (2006.01)
*G03G 15/08* (2006.01)

(52) U.S. Cl.
CPC ..... *G03G 21/1647* (2013.01); *G03G 15/0889* (2013.01); *G03G 21/1676* (2013.01)

(58) Field of Classification Search
CPC ..... G03G 21/1647; G03G 15/0889; G03G 21/1676
See application file for complete search history.

(56) References Cited

U.S. PATENT DOCUMENTS 9,400,450 B2 7/2016 Kikuchi et al.
2013/0051860 A1* 2/2013 Maehara ..... G03G 15/0893 399/254

FOREIGN PATENT DOCUMENTS

JP 2014-224971 A 12/2014

* cited by examiner

*Primary Examiner* — Susan S Lee
(74) *Attorney, Agent, or Firm* — Studebaker & Brackett PC

(57) ABSTRACT

A toner case includes a case main body, a rotator, a transmitter and a lock member. The case main body is configured to store a toner. The rotator is stored in the case main body and configured to rotate around a rotation axis. The transmitter is configured to transmit rotation to the rotator. The lock member is attached to the transmitter and configured to rotate integrally with the transmitter. The lock member is movable between a lock position where rotation of the lock member with respect to the case main body is restricted and a lock release position where the rotation of the lock member with respect to the case main body is allowed.

13 Claims, 11 Drawing Sheets

TONER CASE, IMAGE FORMING APPARATUS AND TONER KIT

INCORPORATION BY REFERENCE

This application is based on and claims the benefit of priority from Japanese patent application No. 2018-078510 filed on Apr. 16, 2018, which is incorporated by reference in its entirety.

BACKGROUND

The present disclosure relates to a toner case, an image forming apparatus including the toner case and a toner kit including the toner case.

An electrophotographic type image forming apparatus includes a toner case configured to replenish a toner (a developer) to a developing device.

For example, the toner case includes a case main body configured to store the toner, a rotator stored in the case main body and a transmitter configured to transmit rotation to the rotator.

SUMMARY

In accordance with an aspect of the present disclosure, a toner case includes a case main body, a rotator, a transmitter and a lock member. The case main body is configured to store a toner. The rotator is stored in the case main body and configured to rotate around a rotation axis. The transmitter is configured to transmit rotation to the rotator. The lock member is attached to the transmitter and configured to rotate integrally with the transmitter. The lock member is movable between a lock position where rotation of the lock member with respect to the case main body is restricted and a lock release position where the rotation of the lock member with respect to the case main body is allowed.

In accordance with an aspect of the present disclosure, an image forming apparatus includes the toner case and an attachment part to which the toner case is attached.

In accordance with an aspect of the present disclosure, a toner kit includes the toner case and a packaging box configured to store the toner case.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus 1 according to an embodiment of the present disclosure will be described. Arrows Fr, Rr, L, R, U and Lo suitably marked in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral complexly having a printing function, a copying function, a facsimile function and the other function, for example.

Figure 1:
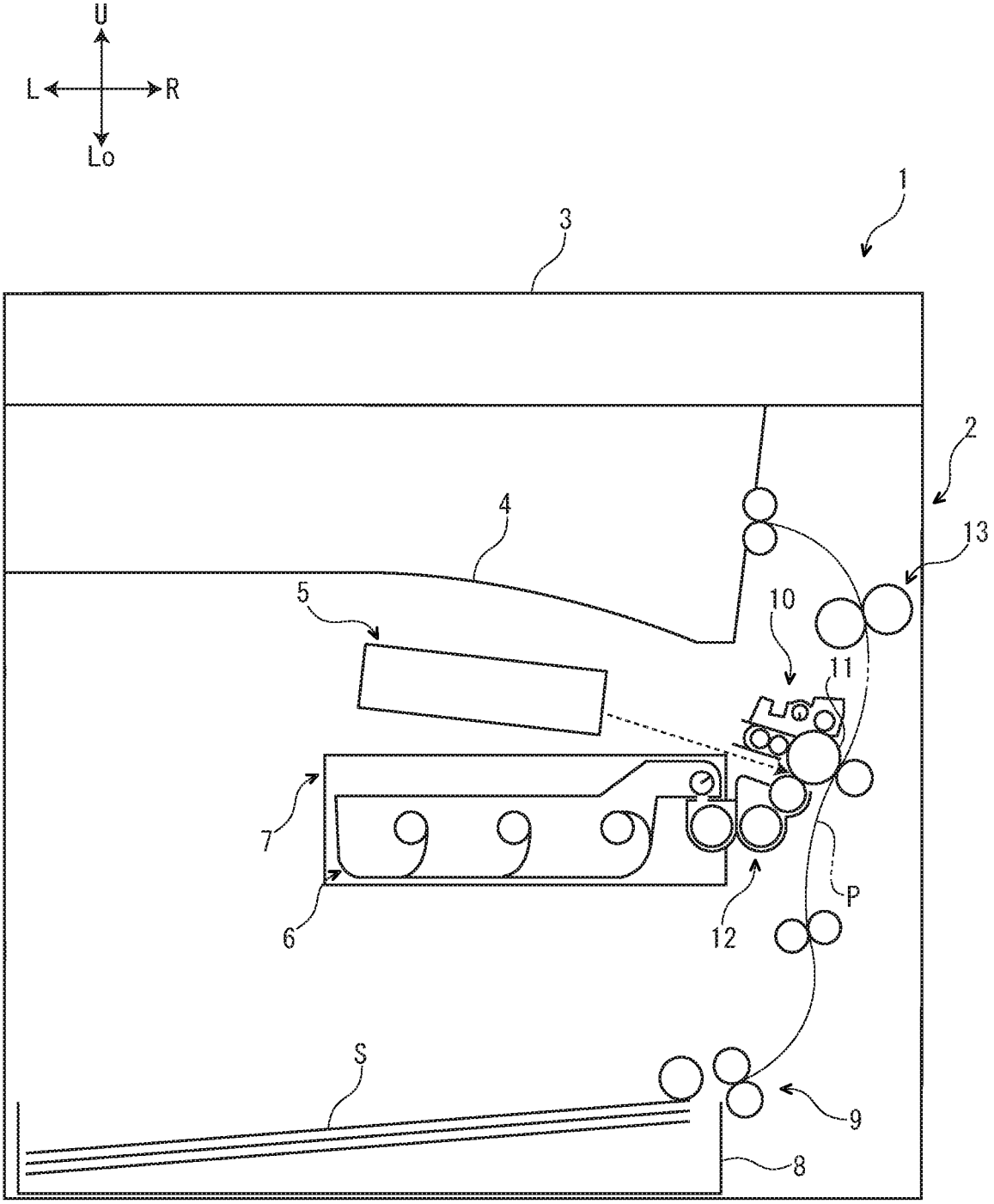
FIG. 1 is a schematic view showing an image forming apparatus according to one embodiment of the present disclosure.

With reference to FIG. 1, the image forming apparatus 1 includes a box-shaped apparatus main body 2. At an upper end portion of the apparatus main body 2, an image reading device 3 configured to read an image of a document is provided. At an upper portion of the apparatus main body 2, an ejected sheet tray 4 is provided. In a center portion in an upper-and-lower direction of the apparatus main body 2, an exposing device 5 is provided below the ejected sheet tray 4. In the center portion in the upper-and-lower direction of the apparatus main body 2, a toner container 6 (an example a toner case) is stored below the exposing device 5. The toner container 6 is detachably attached to an attachment part 7. In a lower end portion of the apparatus main body 2, a sheet feeding cassette 8 storing a sheet S (an example of a recording medium) is stored.

Along a right side portion of the apparatus main body 2, a conveyance path P for the sheet S is provided along the upper-and-lower direction. At an upstream end portion of the conveyance path P, a sheet feeding part 9 is provided. At a midstream portion of the conveyance path P, an image forming part 10 is provided. The image forming part 10 includes a photosensitive drum 11 (an example of an image carrier) and a developing device 12. At a downstream portion of the conveyance path P, a fixing device 13 is provided.

Next, an operation of the image forming apparatus 1 having the above configuration will be described.

First, in a state where a surface of the photosensitive drum 11 is uniformly charged, the exposing device 5 emits laser light (refer to a dotted line arrow in FIG. 1) on the surface of the photosensitive drum 11 to form an electrostatic latent image on the surface of the photosensitive drum 11. Next, the developing device 12 develops the electrostatic latent image to a toner image. Thereby, an image forming operation is completed.

On the other hand, the sheet S fed from the sheet feeding cassette 8 by the sheet feeding part 9 is conveyed to a downstream side along the conveyance path P, and enters the image forming part 10. At the image forming part 10, the toner image is transferred on the sheet S from the surface of the photosensitive drum 11. The sheet S on which the toner image is transferred is conveyed to the downstream side along the conveyance path P, and enters the fixing device 13. The fixing device 13 fixes the toner image on the sheet S. The sheet S on which the toner image is fixed is discharged from a downstream end of the conveyance path P to the ejected sheet tray 4.

Next, the toner container 6 will be further described. An arrow I suitably marked in each figure shows an inside in a front-and-rear direction of the toner container 6 (a side close to a center of the toner container 6 in the front-and-rear direction). An arrow O suitably marked in each figure shows an outside in the front-and-rear direction of the toner container 6 (a side away from the center of the toner container 6 in the front-and-rear direction).

Figure 2:
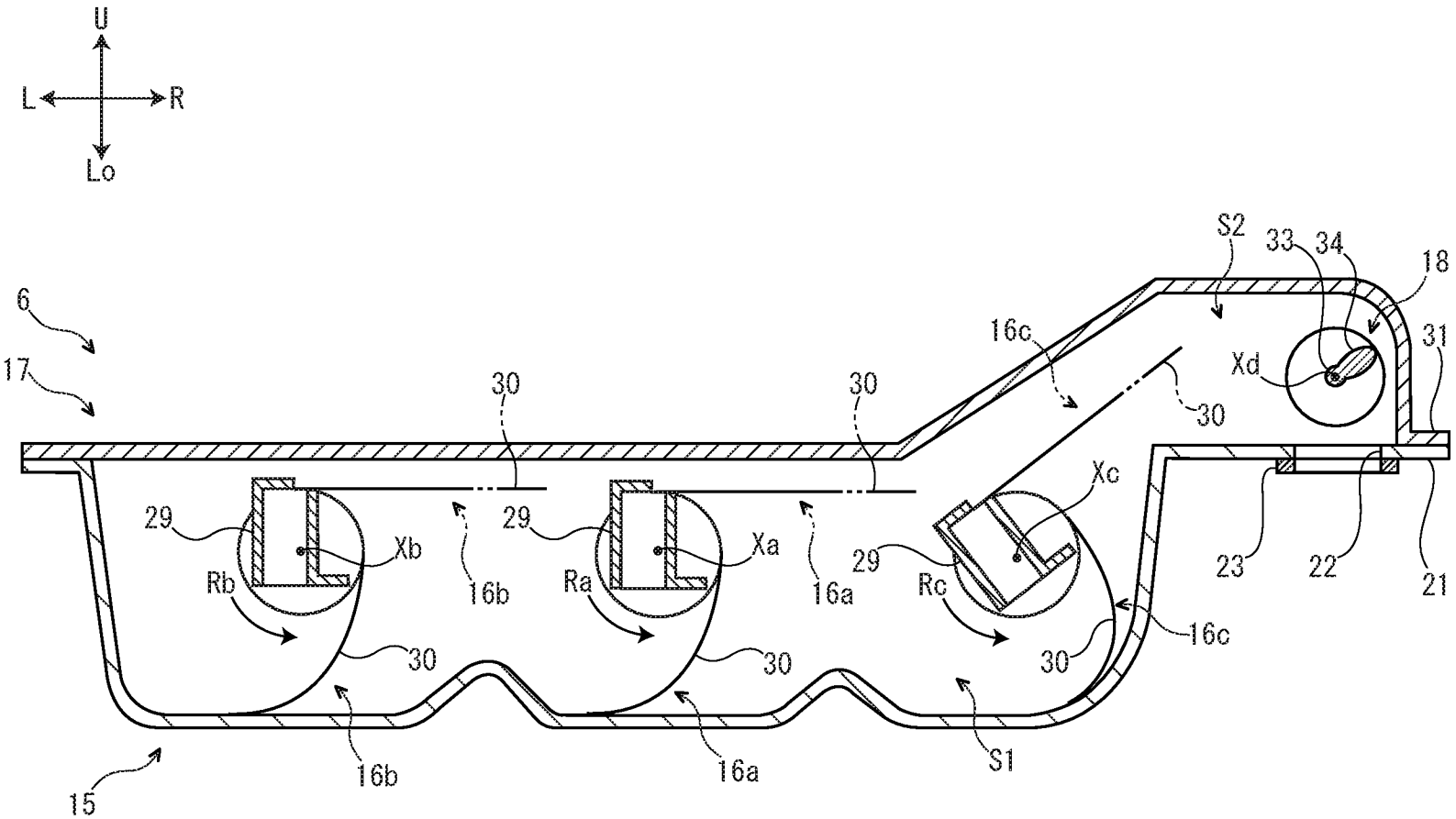
FIG. 2 is a sectional view showing a toner container according to the embodiment of the present disclosure.
Figure 3:
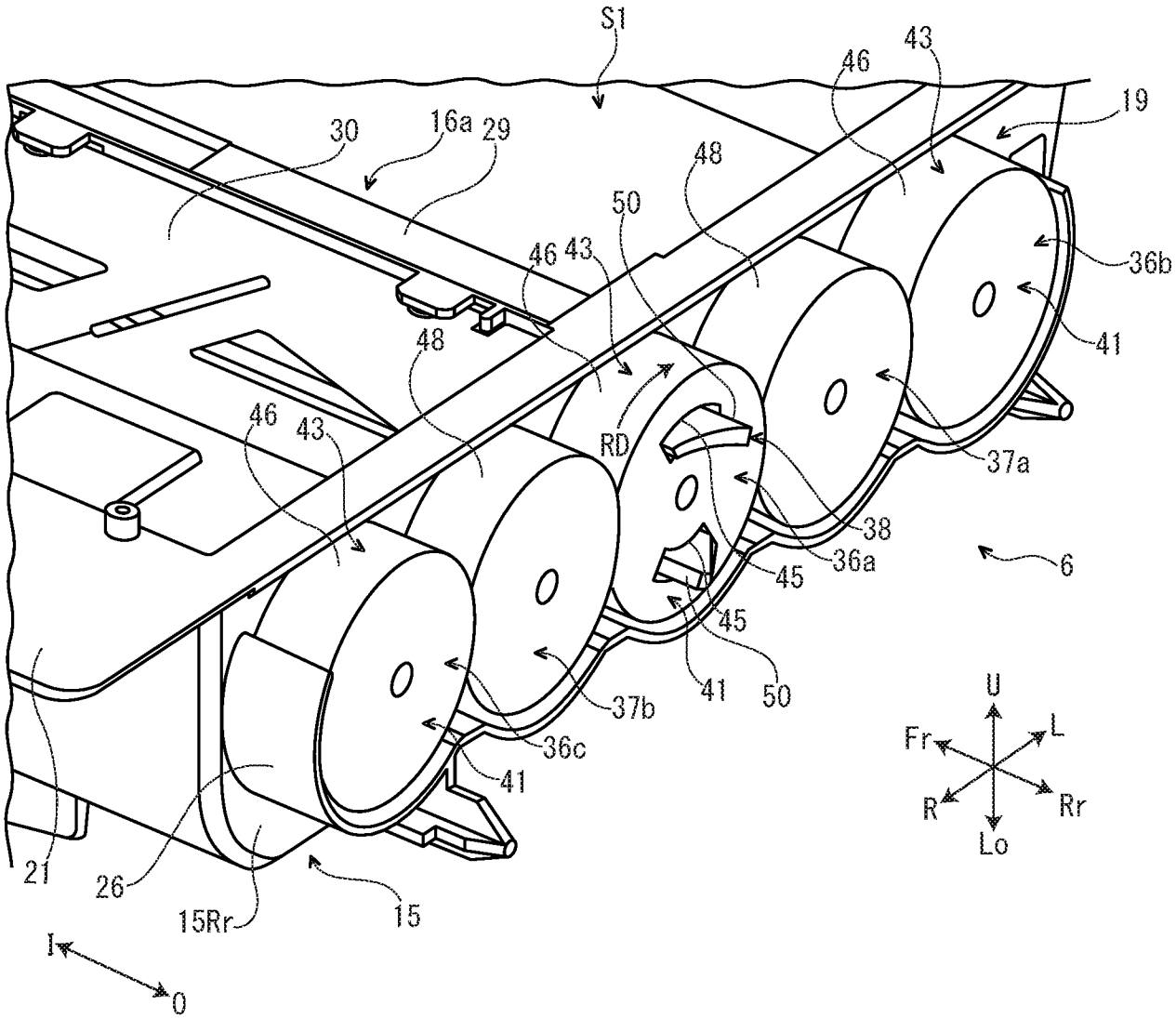
FIG. 3 is a perspective view showing a rear portion of the toner container according to the embodiment of the present disclosure.

With reference to FIG. 2 and FIG. 3, the toner container 6 includes a case main body 15, three agitating paddles 16*a*, 16*b* and 16*c* (an example of a rotator) stored in the case main body 15, a lid body 17 provided at an upper side of the case main body 15, a conveying screw 18 stored in the lid body 17 and a transmitting mechanism 19 provided at a rear side (the outside in the front-and-rear direction) of the case main body 15. The agitating paddles 16*b* and 16*c*, the lid body 17 and the conveying screw 18 are not shown in figures other than FIG. 2.

Inside the case main body 15 of the toner container 6, a storage space S1 is formed. In the storage space S1, a toner (a developer) is stored. Around an outer circumference of an upper end portion of the case main body 15, a main body side flange 21 is provided. In a right side portion of the main body side flange 21, a discharge port 22 is provided. The discharge port 22 is opened and closed by a shutter 23.

Figure 4:
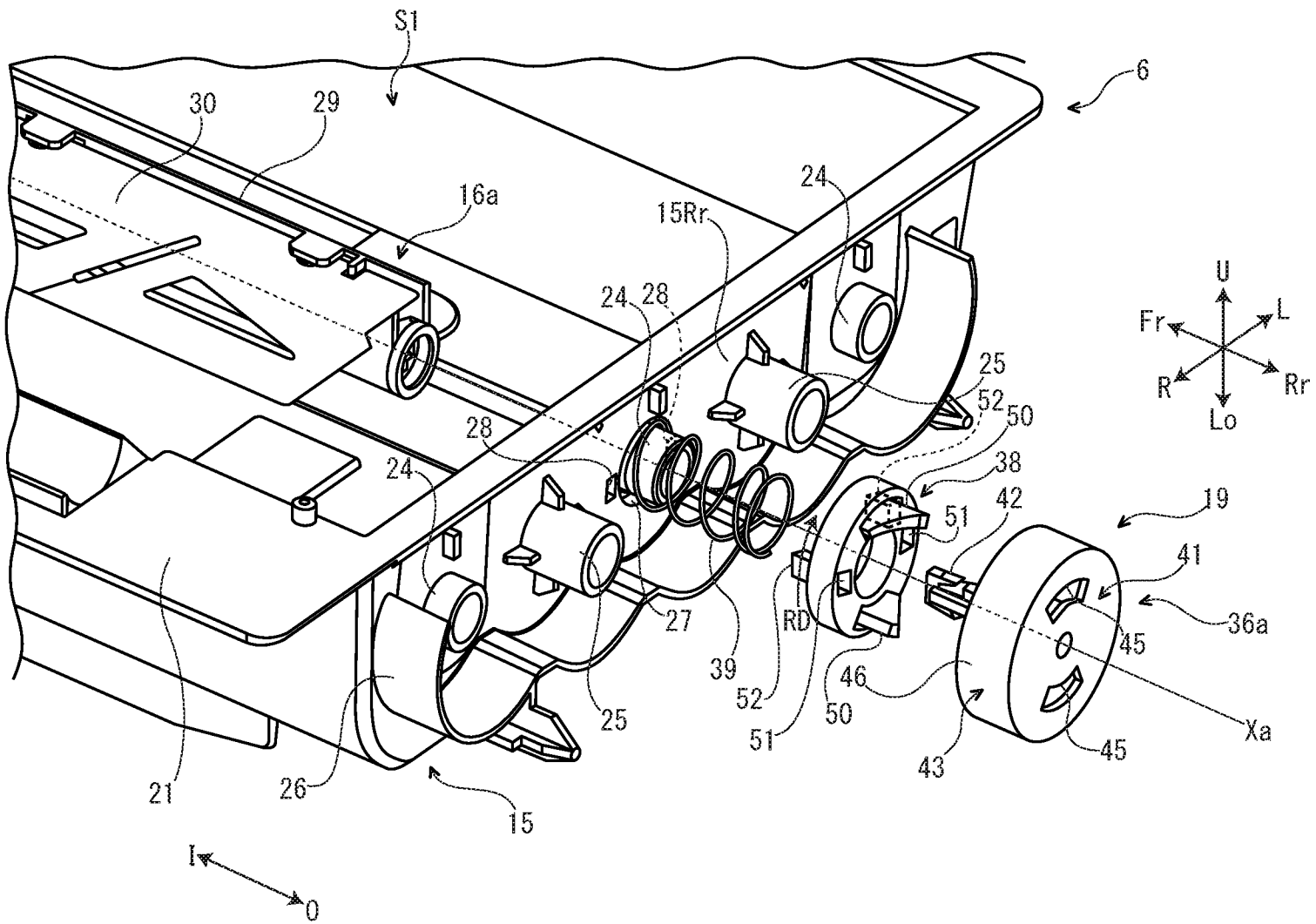
FIG. 4 is a disassembled perspective view showing the rear portion of the toner container according to the embodiment of the present disclosure.

With reference to FIG. 4, on a rear face (an outer face) of a rear end wall 15Rr (one end wall in the front-and-rear direction) of the case main body 15, three main bosses 24 are protruded at intervals in a left-and-right direction. On the rear face of the rear end wall 15Rr of the case main body 15, two sub bosses 25 are protruded between the adjacently arranged main bosses 24. The main bosses 24 and the sub bosses 25 each have a cylindrical shape. On the rear face of the rear end wall 15Rr of the case main body 15, a guide plate 26 is protruded so as to cover a lower side and both left and right sides of the main bosses 24 and the sub bosses 25. On the rear face of the rear end wall 15Rr of the case main body 15, an annular attachment groove 27 is provided around an outer circumference of the main boss 24 arranged at the center in the left-and-right direction. On the rear face of the rear end wall 15Rr of the case main body 15, recesses 28 are provided at both left and right sides of the attachment groove 27.

With reference to FIG. 2, the agitating paddles 16*a*, 16*b* and 16*c* of the toner container 6 are provided at intervals in the left-and-right direction. The agitating paddle 16*a* is stored in a center portion in the left-and-right direction of the storage space S1 of the case main body 15, and rotates around a rotation axis Xa extending along the front-and-rear direction. The agitating paddle 16*b* is stored in a left side portion of the storage space S1 of the case main body 15, and rotates around a rotation axis Xb extending along the front-and-rear direction. The agitating paddle 16*c* is stored in a right side portion of the storage space S1 of the case main body 15, and rotates around a rotation axis Xc extending along the front-and-rear direction. That is, in the present embodiment, the front-and-rear direction is a rotation axis direction of each of the agitating paddles 16*a*, 16*b* and 16*c*.

The agitating paddles 16*a*, 16*b* and 16*c* each include an agitating shaft 29 and an agitating blade 30 provided on an outer circumference of the agitating shaft 29. The agitating shaft 29 extends along each of the rotation axes Xa, Xb and Xc. The agitating blade 30 is formed by resin film, and has flexibility. A base end portion (one end portion in a width direction) of the agitating blade 30 is fixed to the agitating shaft 29. A tip end portion (the other end portion in the width direction) of the agitating blade 30 comes into contact with and separates from an inner face of the case main body 15 as each of the agitating paddles 16*a*, 16*b* and 16*c* rotates (refer to a solid line and a two-dotted chain line in FIG. 2).

Inside the lid body 17 of the toner container 6, a discharge space S2 is formed. The discharge space S2 is provided at a right upper side of the storage space S1 of the case main body 15, and communicated with the storage space S1 of the case main body 15. The discharge space S2 is provided just above the discharge port 22 of the case main body 15, and communicated with the discharge port 22 of the case main body 15. Around an outer circumference of a lower end portion of the lid body 17, a lid body side flange 31 is provided. The lid body side flange 31 is fixed to the main body side flange 21 of the case main body 15. Thereby, the lid body 17 is integrated with the case main body 15.

The conveying screw 18 of the toner container 6 is stored in the discharge space S2 of the lid body 17, and rotates around a rotation axis Xd extending along the front-and-rear direction. That is, in the present embodiment, the front-and-rear direction is a rotation axis direction of the conveying screw 18. The conveying screw 18 includes a conveying shaft 33 extending along the front-and-rear direction and a spiral conveying blade 34 provided around an outer circumference of the conveying shaft 33.

With reference to FIG. 3 and FIG. 4, the transmitting mechanism 19 of the toner container 6 includes three transmitters 36*a*, 36*b* and 36*c* provided at intervals in the left-and-right direction, two connecting members 37*a* and 37*b* provided between adjacently arranged transmitters 36*a*, 36*b* and 36*c*, a lock member 38 attached to the transmitter 36*a* and a coil spring 39 (an example of a biasing member) provided at the front side (the inside in the front-and-rear direction) of the lock member 38. The transmitters 36*b* and 36*c* and the connecting members 37*a* and 37*b* are not shown in figures other than FIG. 3.

The transmitters 36*a*, 36*b* and 36*c* of the transmitting mechanism 19 each include an outer wall part 41, a coupling wall part 42 protruding from an inner circumferential portion of the outer wall part 41 to the front side (the inside in the front-and-rear direction) and a circumferential wall part 43 protruding from an outer circumferential portion of the outer wall part 41 to the front side (the inside in the front-and-rear direction).

The outer wall part 41 of each of the transmitters 36*a*, 36*b* and 36*c* is provided perpendicularly to the front-and-rear direction. The outer wall part 41 is arranged outside the case main body 15. The outer wall part 41 of the transmitter 36*a* has a pair of through holes 45. The through holes 45 are symmetrically provided at both sides of the rotation axis Xa of the agitating paddle 16*a*.

The coupling wall part 42 of each of the transmitters 36*a*, 36*b* and 36*c* extends along the front-and-rear direction. The coupling wall part 42 penetrates through each main boss 24 of the rear end wall 15Rr of the case main body 15, and is inserted into the storage space S1 of the case main body 15. Thereby, the transmitters 36*a*, 36*b* and 36*c* are rotatably supported by the rear end wall 15Rr of the case main body 15. A front end portion of the coupling wall part 42 is coupled to a rear end portion of the agitating shaft 29 of each of the agitating paddles 16*a*, 16*b* and 16*c*. Thereby, the transmitters 36*a*, 36*b* and 36*c* are respectively fixed to the agitating paddles 16*a*, 16*b* and 16*c*.

The circumferential wall part 43 of each of the transmitters 36*a*, 36*b* and 36*c* extends along the front-and-rear direction. The circumferential wall part 43 is arranged outside the case main body 15. Around an outer circumferential face of the circumferential wall part 43, a transmitting gear 46 is provided.

The connecting members 37*a* and 37*b* of the transmitting mechanism 19 are arranged outside the case main body 15. The connecting members 37*a* and 37*b* are attached to the sub bosses 25 of the rear end wall 15Rr of the case main body 15. Thereby, the connecting members 37*a* and 37*b* are rotatably supported by the rear end wall 15Rr of the case main body 15.

Around an outer circumferential face of each of the connecting members 37*a* and 37*b*, a connecting gear 48 is provided. The connecting gear 48 of the connecting member 37*a* is meshed with the transmitting gears 46 of the transmitters 36*a* and 36*b*. Thereby, the transmitter 36*a* is connected to the transmitter 36*b* via the connecting member 37*a*. The connecting gear 48 of the connecting member 37*b* is meshed with the transmitting gears 46 of the transmitters 36*a* and 36*c*. Thereby, the transmitter 36*a* is connected to the transmitter 36*c* via the connecting member 37*b*. A number of teeth of the connecting gear 48 of each of the connecting members 37*a* and 37*b* is equal to a number of teeth of the transmitting gear 46 of each of the transmitters 36*a*, 36*b* and 36*c*. Then, the connecting members 37*a* and 37*b* always rotate at the same speed as the speed of the transmitters 36*a*, 36*b* and 36*c* synchronously.

With reference to FIG. 3 and FIG. 4, the lock member 38 of the transmitting mechanism 19 is arranged outside the case main body 15. The lock member 38 has an annular shape. The lock member 38 is rotatable around the rotation axis Xa of the agitating paddle 16*a*. An arrow RD marked in FIG. 3 and FIG. 4 shows a rotation direction of the lock member 38.

On a rear face (an outer face) of the lock member 38, a pair of driven couplings 50 (an example of a pressed part) is protruded. The driven couplings 50 are symmetrically arranged at both sides of the rotation axis Xa of the agitating paddle 16*a*. A rear face (an outer face) of each driven coupling 50 is inclined to the rear side (the outside in the front-and-rear direction) from an upstream side to a downstream side in the rotation direction of the lock member 38. Each driven coupling 50 is inserted into each through hole 45 of the transmitter 36*a*. Thereby, relative rotation of the lock member 38 with respect to the transmitter 36*a* is restricted, and the lock member 38 is allowed to be rotated integrally with the transmitter 36*a*.

On the rear face (the outer face) of the lock member 38, a pair of grooves 51 is provided. The grooves 51 are symmetrically arranged at both sides of the rotation axis Xa of the agitating paddle 16*a*. On a front face (an inner face) of the lock member 38, a pair of projections 52 is provided at a back side of the pair of grooves 51. The projections 52 are symmetrically arranged at both sides of the rotation axis Xa of the agitating paddle 16*a*. Positions of each groove 51 and each projection 52 are different from a position of each driven coupling 50 in a circumferential direction.

Figure 7:
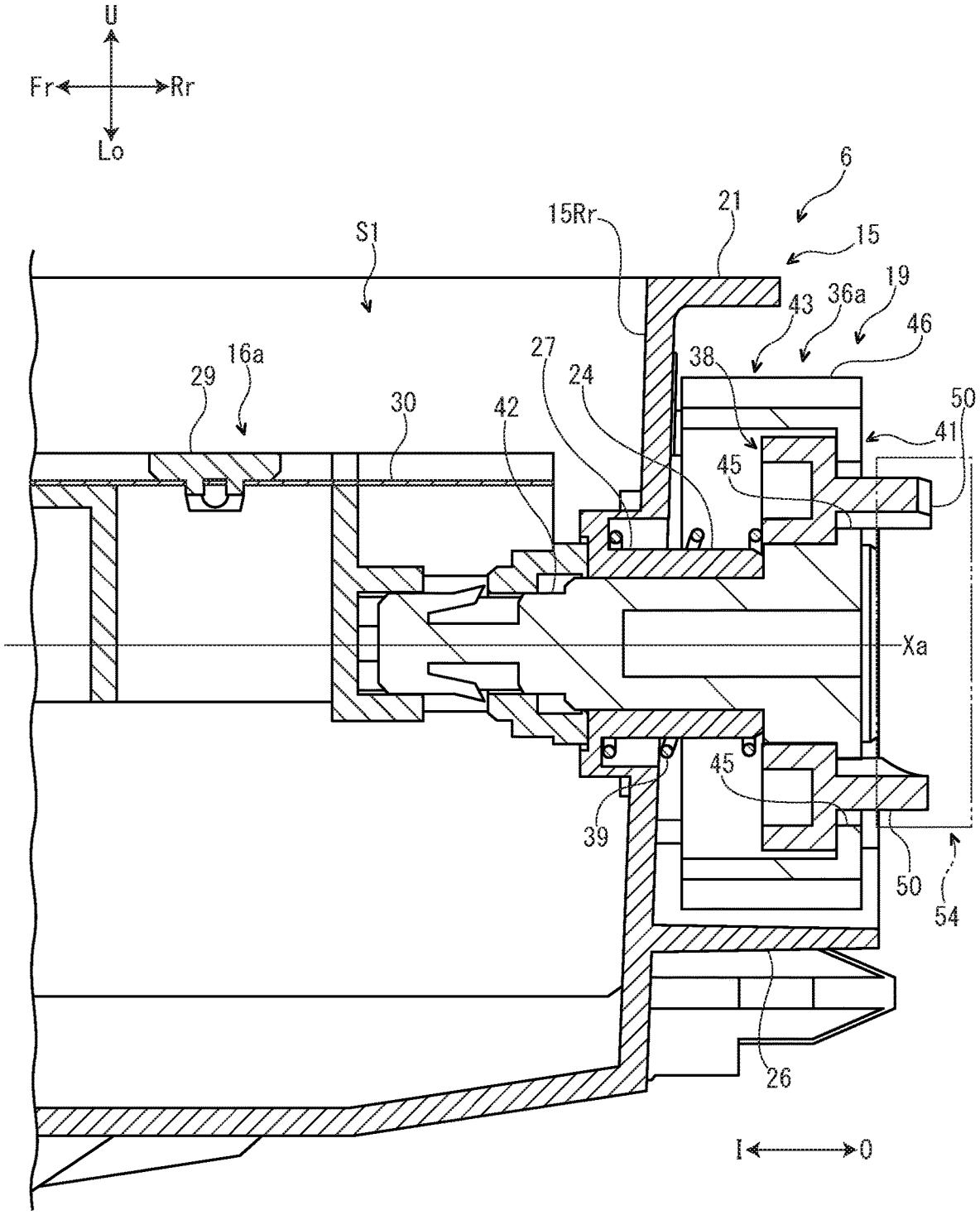
FIG. 7 is a side sectional view showing a state where the lock member is in a lock release position, in the toner container according to the embodiment of the present disclosure.
Figure 8:
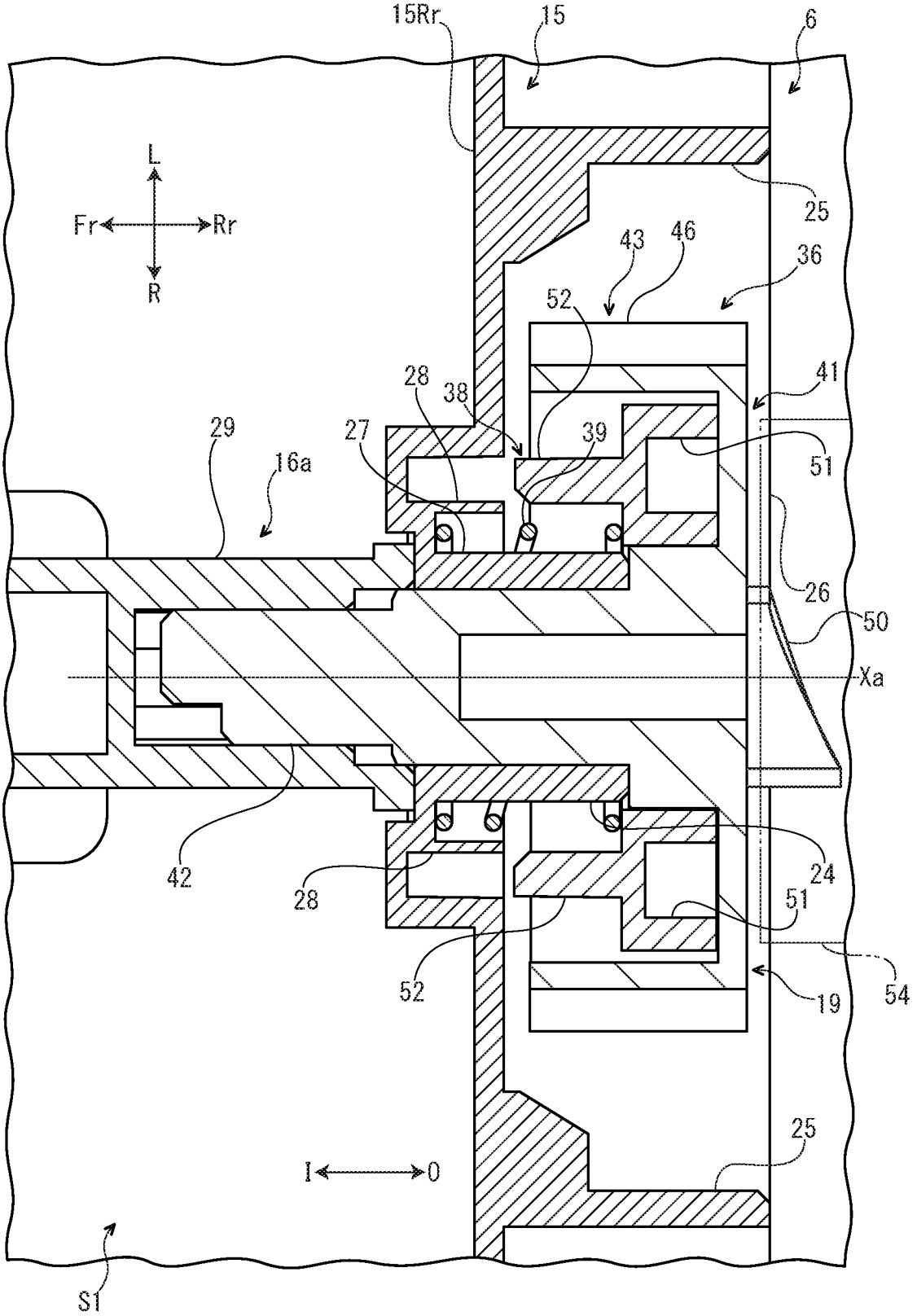
FIG. 8 is a plan sectional view showing the state where the lock member is in the lock release position, in the toner container according to the embodiment of the present disclosure.

The lock member 38 is movable along the front-and-rear direction with respect to the case main body 15 between a lock position (refer to FIG. 5 and FIG. 6) and a lock release position (refer to FIG. 7 and FIG. 8) displaced from the lock position to the rear side (the outside in the front-and-rear direction). In a state where the lock member 38 is in the lock position, each projection 52 of the lock member 38 is fitted into each recess 28 of the rear end wall 15Rr of the case main body 15 to restrict rotation of the lock member 38 with respect to the case main body 15. In a state where the lock member 38 is in the lock release position, fitting of each projection 52 of the lock member 38 into each recess 28 of the rear end wall 15Rr of the case main body 15 is released to allow the rotation of the lock member 38 with respect to the case main body 15.

The coil spring 39 of the transmitting mechanism 19 is arranged outside the case main body 15. The coil spring 39 is attached in the attachment groove 27 of the rear end wall 15Rr of the case main body 15. The coil spring 39 is arranged between the rear end wall 15Rr of the case main body 15 and the lock member 38. The coil spring 39 presses the lock member 38 to the rear side (the outside in the front-and-rear direction) to bias the lock member 38 to the lock release position (refer to FIG. 7 and FIG. 8).

Next, the attachment part 7 will be further described.

Figure 9:
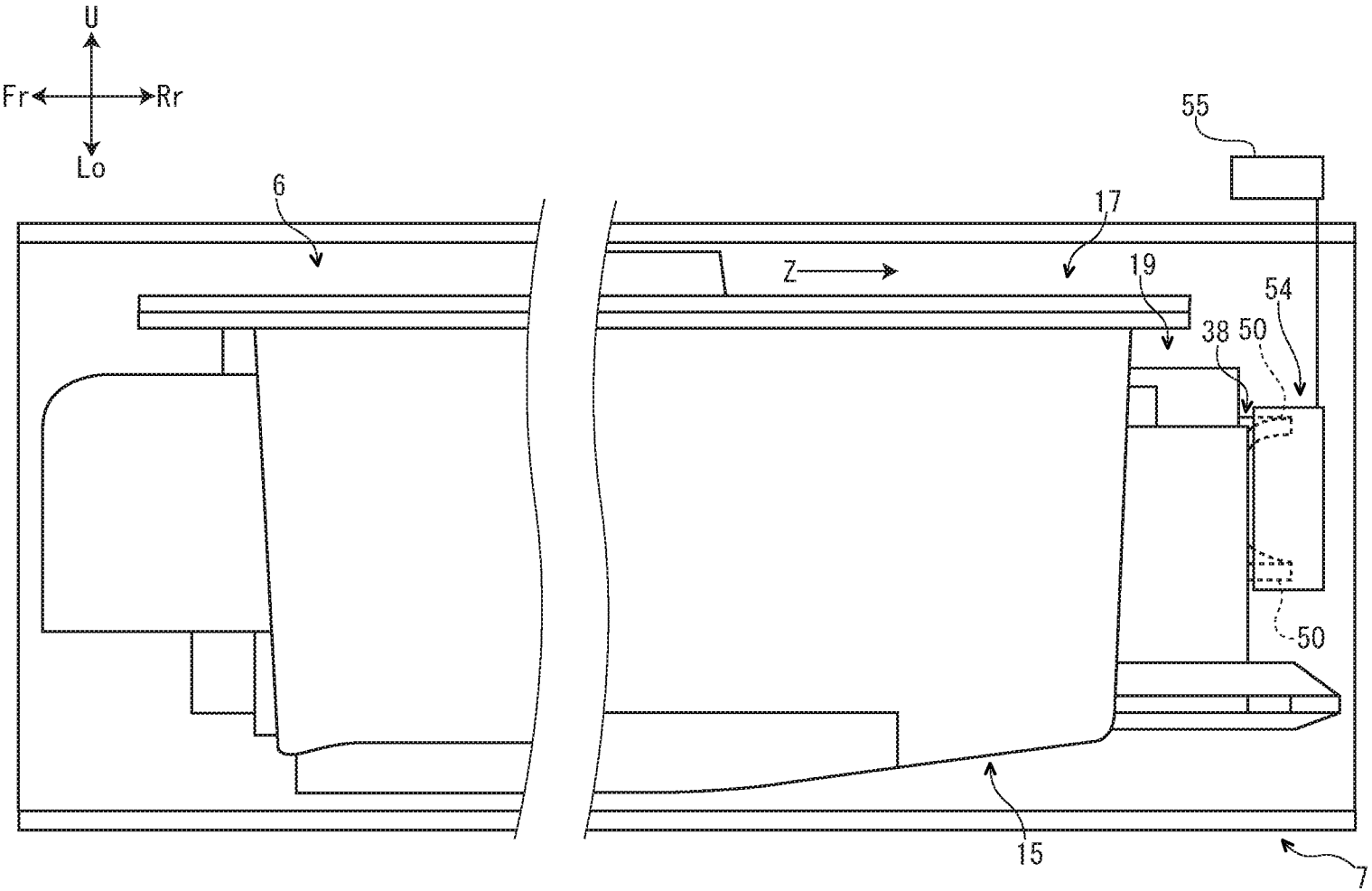
FIG. 9 is a side view showing the toner container and an attachment part according to the embodiment of the present disclosure.

With reference to FIG. 9, the attachment part 7 extends along the front-and-rear direction. To the attachment part 7, the toner container 6 is detachably attached along an attachment direction (refer to an arrow Z in FIG. 9) from the front side to the rear side.

At a rear end portion of the attachment part 7, a drive coupling 54 is provided. The drive coupling 54 is connected to a drive source 55 constituted of a motor, and rotated by rotational drive force from the drive source 55. In a state where the toner container 6 is attached to the attachment part 7 and the lock member 38 is in the lock release position (refer to FIG. 7 and FIG. 8), the drive coupling 54 is configured to engage with each driven coupling 50 of the lock member 38.

Next, a toner kit 61 according to the present embodiment will be described.

Figure 10:
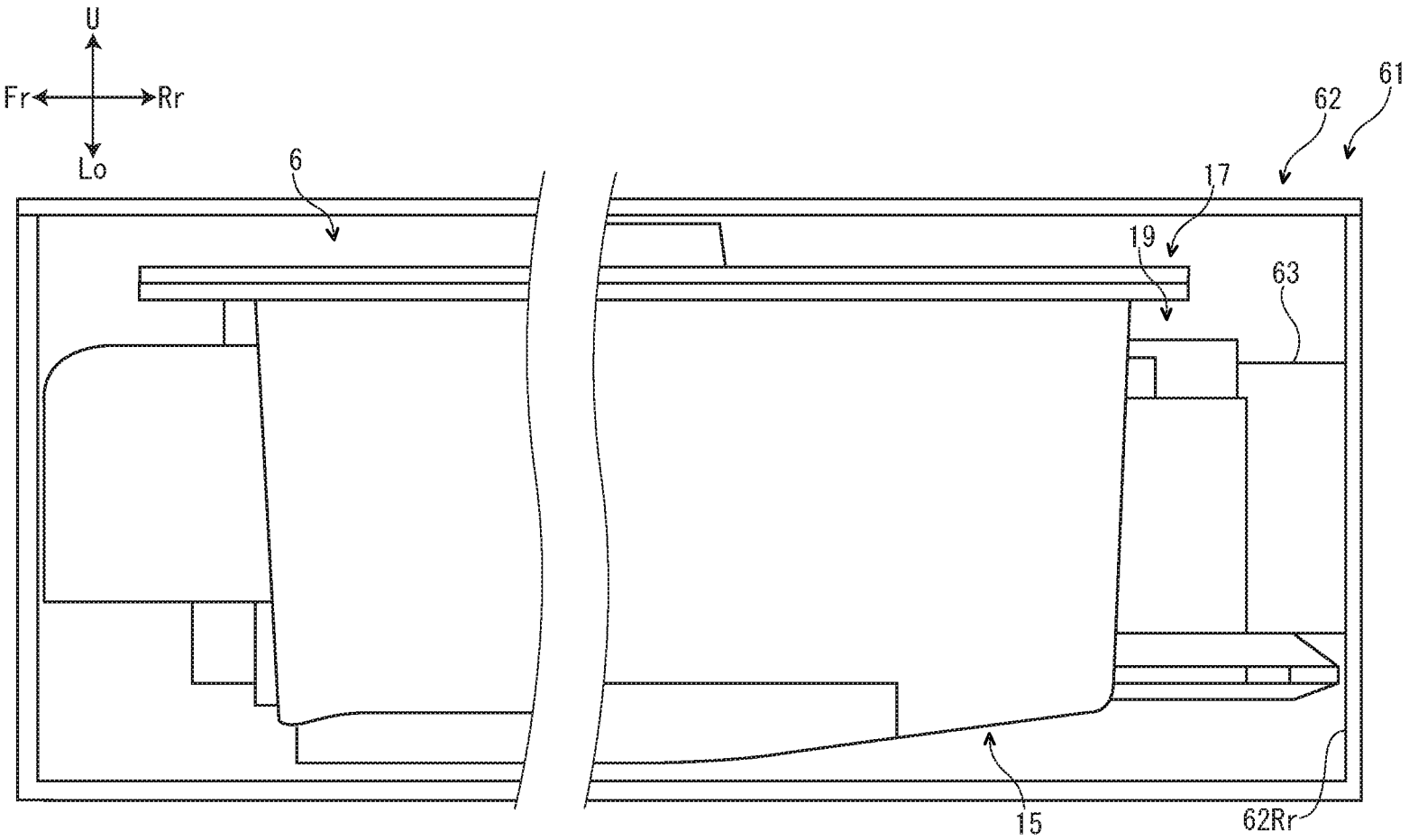
FIG. 10 is a side view showing a state where the toner container is stored in a packaging box, in a toner kit according to the embodiment of the present disclosure.
Figure 11:
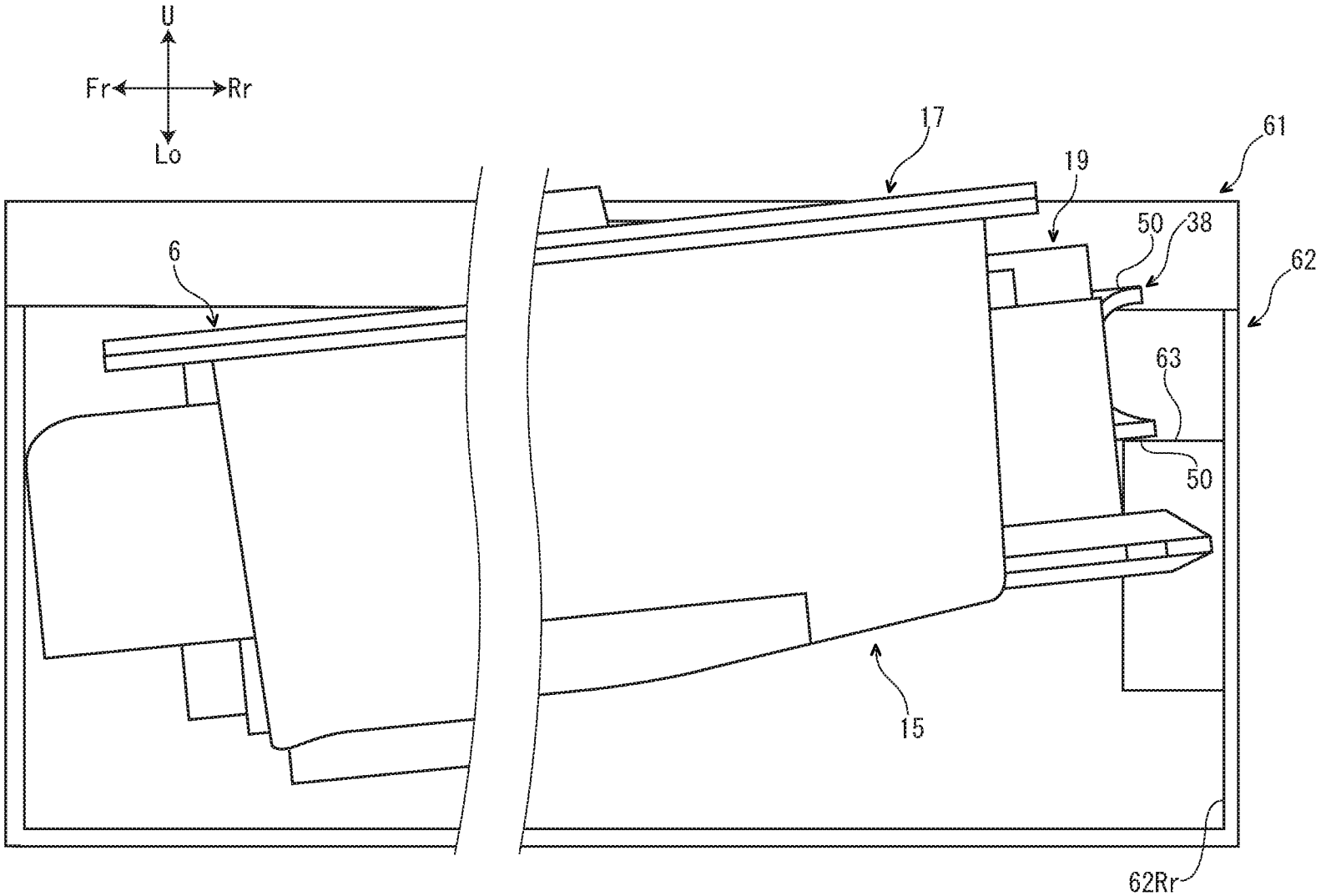
FIG. 11 is a side view showing a state where a pressing part of the packaging box interferes with a driven coupling of the toner container, in the toner kit according to the embodiment of the present disclosure.

With reference to FIG. 10 and FIG. 11, the toner kit 61 includes the above toner container 6 and a packaging box 62 storing the toner container 6.

The packaging box 62 of the toner kit 61 has a parallelepiped shape. In order to show an inside of the packaging box 62 clearly, FIG. 10 and FIG. 11 does not show a right plate (a plate at the near side on the paper plane of FIG. 10 and FIG. 11) of the packaging box 62.

On a front face (an inner face) of a rear end plate 62Rr of the packaging box 62, a pressing part 63 is protruded. In a state where the toner container 6 is stored in the packaging box 62 (refer to FIG. 10), the pressing part 63 presses each driven coupling 50 of the lock member 38 to the front side (the inside in the front-and-rear direction). Thereby, the lock member 38 is kept at the lock position (refer to FIG. 5 and FIG. 6) against the biasing force of the coil spring 39, and the rotation of the lock member 38 with respect to the case main body 15 is restricted.

Next, in the image forming apparatus 1 having the above described configuration, an example of a toner replenish operation from the toner container 6 to the developing device 12 will be described.

When the toner is replenished from the toner container 6 to developing device 12, in the state where the toner container 6 is attached to the attachment part 7 and the lock member 38 is in the lock release position (refer to FIG. 7 and FIG. 8), the drive source 55 is driven. When the drive source 55 is driven, the drive coupling 54 is rotated by the rotational drive force from the drive source 55. When the drive coupling 54 is rotated, the drive coupling 54 presses each driven coupling 50 of the lock member 38, and the lock member 38 is rotated integrally with the drive coupling 54. When the lock member 38 is thus rotated, the rotation of the lock member 38 is transmitted to the agitating paddle 16*a* by the transmitter 36*a*, and the agitating paddle 16*a* is rotated (refer to an arrow Ra in FIG. 2). At this time, the lock member 38, the transmitter 36*a* and the agitating paddle 16*a* are rotated integrally.

When the lock member 38 is rotated as described above, the rotation of the lock member 38 is transmitted to the agitating paddle 16*b* by the transmitter 36*a*, the connecting member 37*a* and the transmitter 36*b*, and the agitating paddle 16*b* is rotated (refer to an arrow Rb in FIG. 2).

Additionally, when the lock member 38 is rotated as described above, the rotation of the lock member 38 is transmitted to the agitating paddle 16*c* by the transmitter 36*a*, the connecting member 37*b* and the transmitter 36*c*, and the agitating paddle 16*c* is rotated (refer to an arrow Rc in FIG. 2).

When the agitating paddles 16*a*, 16*b* and 16*c* are rotated in the above manner, the toner in the storage space S1 of the case main body 15 is conveyed to the right side while agitated by the agitating paddles 16*a*, 16*b* and 16*c*. The toner conveyed to the right side is lifted in the discharge space S2 of the lid body 17 by the agitating paddle 16*c*.

Additionally, when the drive source 55 is driven as described above, the conveying screw 18 is rotated by the rotational drive force from the drive source 55. When the conveying screw 18 is thus rotated, the toner lifted in the discharge space S2 of the lid body 17 by the agitating paddle 16*c* is conveyed to the discharge port 22 of the case main body 15 by the conveying screw 18, discharged through the discharge port 22 of the case main body 15 and introduced to the developing device 12. Then, the toner is replenished to the developing device 12 from the toner container 6.

By the way, when the agitating paddles 16*a*, 16*b* and 16*c* are rotated as described above, rotation positions of the agitating paddles 16*a*, 16*b* and 16*c* are varied. In a state where the agitating paddles 16*a*, 16*b* and 16*c* are in a first rotation position (refer to the solid line in FIG. 2), the tip end portion of each agitating blade 30 of the agitating paddles 16*a*, 16*b* and 16*c* comes into contact with the inner face of the case main body 15. Then, the agitating blade 30 bends in an arc-shape and a load applied to the agitating blade 30 increases.

On the other hand, in a state where the agitating paddles 16*a*, 16*b* and 16*c* are in a second rotation position (refer to the two-dotted chain line in FIG. 2), the tip end portion of each agitating blade 30 of the agitating paddles 16*a*, 16*b* and 16*c* separates from the inner face of the case main body 15. Then, the agitating blade 30 extends in a flat plate shape and the load applied to the agitating blade 30 decreases. In the state where the agitating paddles 16*a*, 16*b* and 16*c* are in the second rotation position (refer to the two-dotted chain line in FIG. 2), the tip end portion of each agitating blade 30 of the agitating paddles 16*a* and 16*b* are stored in the storage space S1 of the case main body 15 and the tip end portion of the agitating blade 30 of the agitating paddle 16*c* is stored in the discharge space S2 of the lid body 17.

At a shipping or a transporting of the toner container 6, if the toner container 6 is left for a long period in the state where the agitating paddles 16*a*, 16*b* and 16*c* are in the first rotation position (refer to the solid line in FIG. 2), the agitating blade 30 is being applied with the large load and then plastically deformed as bent in the arc-shape. When such a situation occurs, a rotation orbit of the agitating blade 30 becomes narrow at a use of the toner container 6, and the agitating blade 30 may not agitate and convey the toner in the storage space S1 of the case main body 15 sufficiently.

Then, at a packaging of the toner container 6, in the state where the agitating paddles 16*a*, 16*b* and 16*c* are in the second rotation position (refer to the two-dotted chain line in FIG. 2), an operator stores the toner container 6 in the packaging box 62. If the rotation positions of the agitating paddles 16*a*, 16*b* and 16*c* are not varied, it becomes possible to inhibit the agitating blade 30 from being kept with the large load applied and from being deformed plastically.

However, at the shipping or the transporting of the toner container 6, if the operator falls the toner container 6 accidentally or the toner container 6 is applied with vibration, the agitating paddles 16*a*, 16*b* and 16*c* may rotate. Alternately, at the shipping or the transporting of the toner container 6, if the operator rotates the transmitters 36*a*, 36*b* and 36*c* accidentally, the rotation of the transmitters 36*a*, 36*b* and 36*c* is transmitted to the agitating paddles 16*a*, 16*b* and 16*c*, and the agitating paddles 16*a*, 16*b* and 16*c* may be rotated. When the agitating paddles 16*a*, 16*b* and 16*c* are rotated at the shipping or the transporting of the toner container 6, the rotation positions of the agitating paddles 16*a*, 16*b* and 16*c* are varied from the second rotation position (refer to the two-dotted chain line in FIG. 2) to the first rotation position (refer to the solid line in FIG. 2), and the plastic deformation of the agitating blade 30 may not be inhibited. Then, the present embodiment makes it possible to inhibit the agitating paddles 16*a*, 16*b* and 16*c* from being rotated at the shipping or the transporting of the toner container 6 by the following manner.

At the packaging of the toner container 6, the operator first adjusts the rotation position of the lock member 38 such that the driven couplings 50 of the lock member 38 are aligned in the upper-and-lower direction (refer to FIG. 3). As a result, the rotation positions of the agitating paddles 16*a*, 16*b* and 16*c* connected to the lock member 38 are also adjusted, and the agitating paddles 16*a*, 16*b* and 16*c* are arranged in the second rotation position (refer to the two-dotted chain line in FIG. 2). Then, the tip end portion of each agitating blade 30 of the agitating paddles 16*a*, 16*b* and 16*c* separates from the inner face of the case main body 15. Additionally, when the operator adjusts the rotation position of the lock member 38 in the above manner, each projection 52 of the lock member 38 faces each recess 28 of the case main body 15.

Next, the operator presses each driven coupling 50 of the lock member 38 to the front side (the inside in the front-and-rear direction). Then, the lock member 38 is moved from the lock release position (refer to FIG. 7 and FIG. 8) to the lock position (refer to FIG. 5 and FIG. 6) against the biasing force of the coil spring 39, and each projection 52 of the lock member 38 is fitted into each recess 28 of the case main body 15. This restricts the rotation of the lock member 38 with respect to the case main body 15 and also the rotation of each of the agitating paddles 16*a*, 16*b* and 16*c* connected to the lock member 38.

Figure 5:
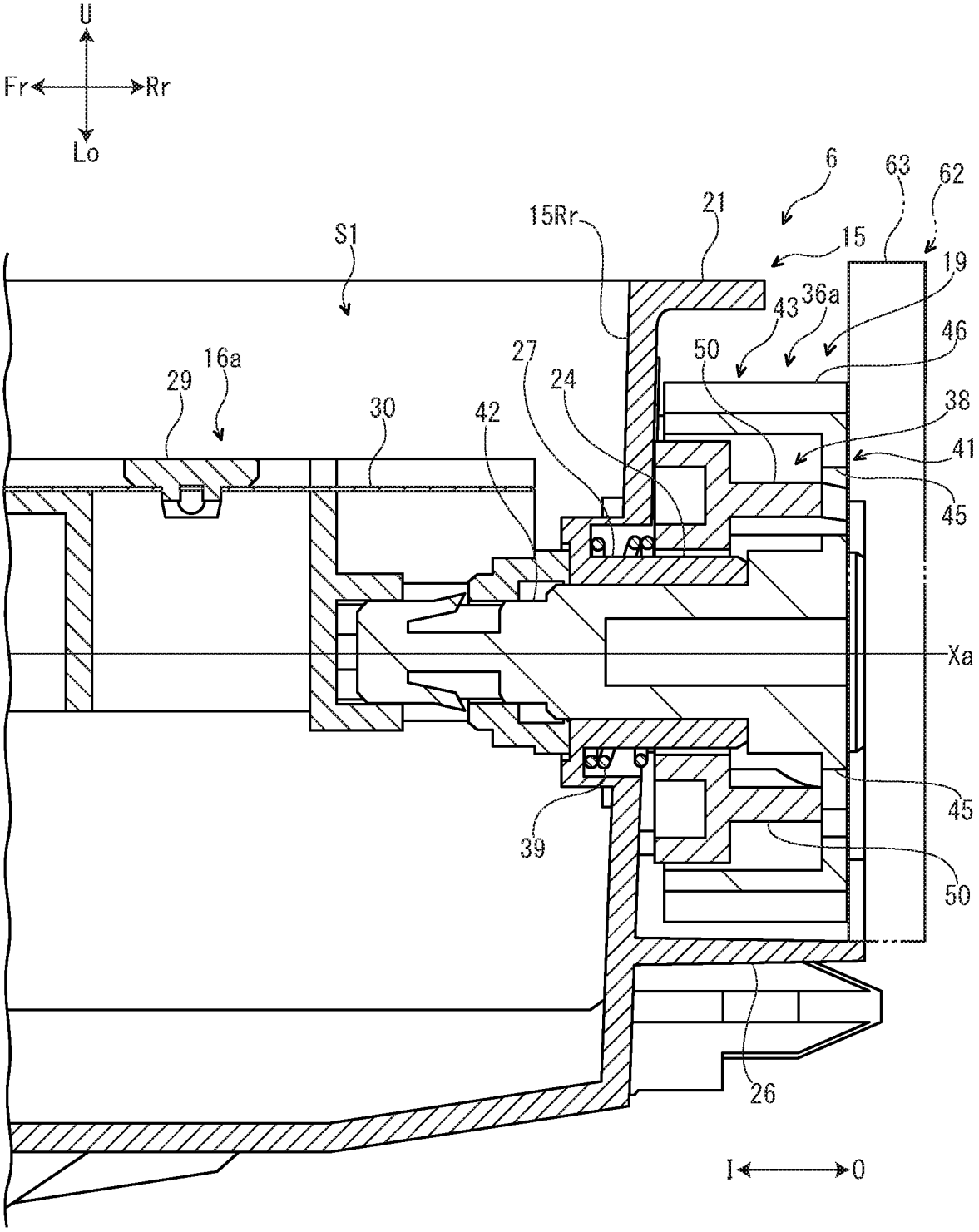
FIG. 5 is a side sectional view showing a state where a lock member is in a lock position, in the toner container according to the embodiment of the present disclosure.
Figure 6:
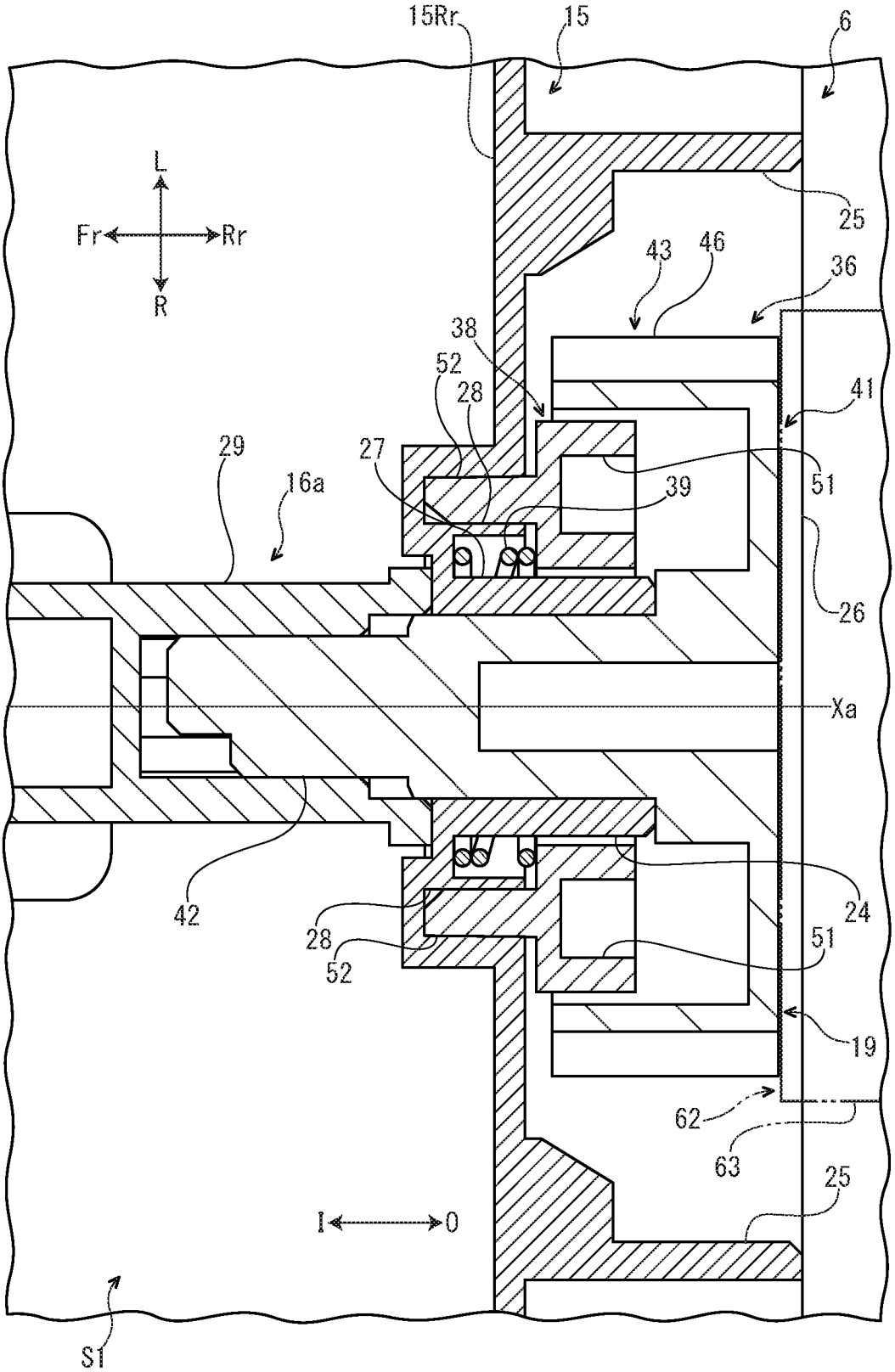
FIG. 6 is a plan sectional view showing the state where the lock member is in the lock position, in the toner container according to the embodiment of the present disclosure.

Next, the operator stores the toner container 6 in the packaging box 62 while the lock member 38 being kept at the lock position (refer to FIG. 5 and FIG. 6). Then, the pressing part 63 of the packaging box 62 presses each driven coupling 50 of the lock member 38 to the front side (the inside in the front-and-rear direction), and the lock member 38 is kept at the lock position (refer to FIG. 5 and FIG. 6) against the biasing force of the coil spring 39.

At the use of the toner container 6, a user or a serviceman takes the toner container 6 out from the packaging box 62. This releases the pressing of the pressing part 63 of the packaging box 62 to each driven coupling 50 of the lock member 38, and the lock member 38 is moved from the lock position (refer to FIG. 5 and FIG. 6) to the lock release position (refer to FIG. 7 and FIG. 8) by the biasing force of the coil spring 39.

As described above, the lock member 38 is movable between the lock position where the rotation of the lock member 38 with respect to the case main body 15 is restricted and the lock release position where the rotation of the lock member 38 with respect to the case main body 15 is allowed. By applying such a configuration, when the lock member 38 is moved to the lock position, it becomes possible to restrict the rotation of the lock member 38, the transmitters 36*a*, 36*b* and 36*c* and the agitating paddles 16*a*, 16*b* and 16*c*. Accordingly, it becomes possible to inhibit the rotation of the agitating paddles 16*a*, 16*b* and 16*c* at the shipping or the transporting of the toner container 6.

Additionally, in the state where the lock member 38 is in the lock position, each agitating blade 30 of the agitating paddles 16*a*, 16*b* and 16*c* separates from the inner face of the case main body 15. By applying such a configuration, it becomes possible to inhibit the agitating blade 30 from being kept with the large load applied and being deformed plastically.

Additionally, in the state where the lock member 38 is in the lock position, each projection 52 of the lock member 38 is fitted into each recess 28 of the case main body 15 to restrict the rotation of the lock member 38 with respect to the case main body 15. By applying such a configuration, it becomes possible to surely restrict the rotation of the lock member 38 by using a simple structure.

Additionally, the lock member 38 is movable along the front-and-rear direction (the rotation axis direction of each of the agitating paddles 16*a*, 16*b* and 16*c*) between the lock position and the lock release position. By applying such a configuration, it becomes possible to move the lock member 38 smoothly.

Additionally, when the operator presses each driven coupling 50 of the lock member 38, the lock member 38 is moved from the lock release position to the lock position against the biasing force of the coil spring 39. By applying such a configuration, at the use of the toner container 6, it becomes possible to surely return the lock member 38 from the lock position to the lock release position by the biasing force of the coil spring 39.

The image forming apparatus 1 includes the toner container 6 and the attachment part 7 to which the toner container 6 is attached. By applying such a configuration, it becomes possible to provide the image forming apparatus 1 including the toner container 6 capable of inhibiting the rotation of the agitating paddles 16*a*, 16*b* and 16*c* at the shipping or the transporting of the toner container 6.

In the present embodiment, each driven coupling 50 configured to engage with the drive coupling 54 is formed as the pressed part. By applying such a configuration, compared with a case where the pressed part is formed separately from each driven coupling 50, it becomes possible to inhibit complication of the structure of the toner container 6.

The toner kit 61 includes the toner container 6 and the packaging box 62 storing the toner container 6. By applying such a configuration, it becomes possible to provide the toner kit 61 including the toner container 6 capable of inhibiting the rotation of the agitating paddles 16*a*, 16*b* and 16*c* at the shipping or the transporting of the toner container 6.

Additionally, in the state where the toner container 6 is stored in the packaging box 62, the pressing part 63 of the packaging box 62 presses each driven coupling 50 of the lock member 38 to keep the lock member 38 at the lock position against the biasing force of the coil spring 39. By applying such a configuration, it becomes possible to surely inhibit the rotation of the agitating paddles 16*a*, 16*b* and 16*c* in the state where the toner container 6 is stored in the packaging box 62.

In the present embodiment, if the toner container 6 is tried to be stored in the packaging box 62 in the state where the lock member 38 is in the lock release position, the pressing part 63 of the packaging box 62 interferes with each driven coupling 50 of the lock member 38 and the toner container 6 is restricted from being stored in the packaging box 62 (refer to FIG. 11). By applying such a configuration, it becomes possible to avoid a situation where the toner container 6 is stored in the packaging box 62 in the state where the lock member 38 is in the lock release position, and it becomes possible to inhibit the rotation of the agitating paddles 16*a*, 16*b* and 16*c* more surely in the state where the toner container 6 is stored in the packaging box 62.

In the present embodiment, the projection 52 provided in the lock member 38 is fitted into the recess 28 provided in the case main body 15. On the other hand, in the other hands, the projection 52 provided in the case main body 15 may be fitted into the recess 28 provided in the lock member 38.

In the present embodiment, each driven coupling 50 configured to engage with the drive coupling 54 is formed as the pressed part. On the other hand, in the other embodiments, the pressed part may be formed separately from each driven coupling 50.

In the present embodiment, the three agitating paddles 16*a*, 16*b* and 16*c* are stored in the case main body 15. On the other hand, in the other embodiments, one, two, four or more agitating paddles may be stored in the case main body 15.

In the present embodiment, the agitating paddles 16*a*, 16*b* and 16*c* are an example of the rotator. On the other hand, in the other embodiments, the conveying screw 18 and the other, other than the agitating paddle, may be an example of the rotator.

In the present embodiment, the image forming apparatus 1 is the multifunctional peripheral. On the other hand, in the other embodiments, the image forming apparatus 1 may be a printer, a copying machine, a facsimile or the others.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body configured to store a toner;

a rotator stored in the case main body and configured to rotate around a rotation axis;

a transmitter configured to transmit rotation to the rotator; and a lock member attached to the transmitter and configured to rotate integrally with the transmitter, wherein the lock member is movable between a lock position where rotation of the lock member with respect to the case main body is restricted and a lock release position where the rotation of the lock member with respect to the case main body is allowed.

2. The toner case according to claim 1, wherein the rotator is an agitating paddle configured to agitate the toner in the case main body, the agitating paddle includes:

an agitating shaft configured to extend along the rotation axis; and an agitating blade fixed to the agitating shaft and configured to come into contact with and separate from an inner face of the case main body, and in a state where the lock member is in the lock position, the agitating blade separates from the inner face of the case main body.

3. The toner case according to claim 1, wherein the case main body includes one of a recess and a projection, the lock member includes another of the recess and the projection, in a state where the lock member is in the lock position, the projection is fitted into the recess to restrict the rotation of the lock member with respect to the case main body, and in a state where the lock member is in the lock release position, fitting of the projection into the recess is released to allow the rotation of the lock member with respect to the case main body.

4. The toner case according to claim 1, wherein the lock member is movable along a rotation axis direction of the rotator with respect to the case main body between the lock position and the lock release position.

5. The toner case according to claim 1, further comprising a biasing member configured to bias the lock member to the lock release position, wherein the lock member is arranged outside the case main body, a pressed part is provided on an outer face of the lock member, and when the pressed part is pressed, the lock member is moved from the lock release position to the lock position against biasing force of the biasing member.

6. The toner case according to claim 5, wherein the biasing member is a coil spring arranged between the case main body and the lock member.

7. The toner case according to claim 5, wherein the transmitter includes an outer wall part provided perpendicularly to a rotation axis direction of the rotator, the outer wall part has a through hole, and the pressed part is inserted into the through hole so that relative rotation of the lock member with respect to the transmitter is restricted.

8. The toner case according to claim 5, wherein an outer face of the pressed part is inclined to an outside in a rotation axis direction of the rotator from an upstream side toward a downstream side in a rotation direction of the lock member.

9. An image forming apparatus comprising:

the toner case according to claim 1; and an attachment part to which the toner case is attached.

10. An image forming apparatus comprising:

the toner case according to claim 5; and an attachment part to which the toner case is attached, wherein the attachment part includes a drive coupling configured to rotate by rotational drive force from a drive source, the pressed part is a driven coupling configured to engage with the drive coupling, and when the drive coupling is rotated in a state where the toner case is attached to the attachment part, the drive coupling presses the driven coupling to rotate the lock member.

11. A toner kit comprising:

the toner case according to claim 1; and a packaging box configured to store the toner case.

12. A toner kit comprising:

the toner case according to claim 5; and a packaging box configured to store the toner case, wherein a pressing part is provided on an inner face of the packaging box, and the pressing part presses the pressed part in a state where the toner case is stored in the packaging box so that the lock member is kept at the lock position against the biasing force of the biasing member.

13. The toner kit according to claim 12, when the toner case is tried to be stored in the packaging box in a state where the lock member is in the lock release position, the pressing part interferes with the pressed part to restrict the toner case from being stored in the packaging box.

* * * * *